US006505531B2

(12) United States Patent
Stogner

(10) Patent No.: US 6,505,531 B2
(45) Date of Patent: Jan. 14, 2003

(54) OIL TOOL CONNECTION BREAKER AND METHOD

(75) Inventor: Huey Stogner, League City, TX (US)

(73) Assignee: Access Oil Tools, Inc., Broussard, LA (US)

( * ) Notice: Subject to any disclaimer, the term of this patent is extended or adjusted under 35 U.S.C. 154(b) by 0 days.

(21) Appl. No.: 09/726,730

(22) Filed: Nov. 30, 2000

(65) Prior Publication Data

US 2002/0062717 A1 May 30, 2002

(51) Int. Cl.[7] ..... B25B 17/00
(52) U.S. Cl. ..... 81/57.16; 81/57.24; 81/57.34
(58) Field of Search ..... 81/57.16, 57.24, 81/57.34, 57.35; 29/426.1, 428

(56) References Cited

U.S. PATENT DOCUMENTS

| | | | | | |
|---|---|---|---|---|---|
| 107,255 | A | * | 9/1870 | Harris | 81/124.2 |
| 3,799,009 | A | * | 3/1974 | Guier | 81/57.16 |
| 3,902,385 | A | * | 9/1975 | Haby | 81/57.34 |
| 3,921,473 | A | * | 11/1975 | Boyadjieff et al. | 81/57.34 |
| 4,326,435 | A | * | 4/1982 | Guillot et al. | 81/57.34 |
| 4,423,648 | A | * | 1/1984 | Toelke | 81/57.34 |
| 4,495,840 | A | * | 1/1985 | Freitag et al. | 81/57.34 |
| 4,794,825 | A | * | 1/1989 | Schmoyer | 81/57.39 |
| 5,231,899 | A | * | 8/1993 | Lee | 81/57.16 |
| 5,386,746 | A | * | 2/1995 | Hauk | 81/57.34 |
| 5,520,072 | A | * | 5/1996 | Perry | 81/57.16 |
| 5,758,553 | A | * | 6/1998 | Perry | 81/57.34 |
| 5,842,390 | A | * | 12/1998 | Bouligny et al. | 81/57.34 |
| 5,845,549 | A | * | 12/1998 | Bouligny | 81/57.34 |
| 6,116,118 | A | * | 9/2000 | Wesch, Jr. | 81/57.34 |
| 6,311,789 | B1 | * | 11/2001 | Saxman | 175/57 |

* cited by examiner

*Primary Examiner*—James G. Smith
*Assistant Examiner*—Hadi Shakeri
(74) *Attorney, Agent, or Firm*—Daniel N. Lundeen; Lundeen & Dickinson LLP

(57) ABSTRACT

The present invention relates to a transverse bitbreaker plate, which is attached to the lower surface of a power wrench to effect the coupling or decoupling of downhole tools such as bits or stabilizers. The plate is hinged and provides a generally triangular shaped profile along through its transverse surface which mates with the bit or stabilizer, which is to be connected or disconnected. The hinged plate is removably attached below the power wrench with pins so that it may be used and removed in a minimum of time.

20 Claims, 5 Drawing Sheets

OIL TOOL CONNECTION BREAKER AND METHOD

FIELD OF THE INVENTION

The present invention relates to an oil tool coupling and decoupling apparatus; more specifically, to an apparatus used for making up or breaking the connection between a downhole tool, such as a drill bit or stabilizer, and the drill string to which either is connected.

BACKGROUND OF THE INVENTION

In the process of drilling, "tripping" drill pipe into and out of the bore hole primarily requires repetitive connecting and disconnecting of the tubular members, but also less frequently requires repetitive connecting and disconnecting of stabilizers to a tubular drill string, and repetitive connecting and disconnecting the bit from the terminal end of the drill string. Historically, these connections were made by rig personnel moving a set of power wrenches or tongs onto the rig floor to engage the drill pipe and apply torque against the pipe as it was held fixed in location by the rotary table or the topdrive unit. Other devices, referred to as bitbreakers by those in the art, included a fixed metal plate, having the profile of the bit that was attached to the rotary table. Modern drilling rig rental rates dictate that this coupling/decoupling process be performed quickly to minimize the day rental charges for the drilling rig. Various forms of automated machinery have been proposed over the years for moving power tongs into and out of engagement with the drill string to perform these services. None, so far as known to applicant, combine the benefits of the bitbreaker with the automated features of the automated wrenches or tongs.

One form of automated wrenches or tongs moves an apparatus on a track into engagement with the drill string. These units move into engagement and automatically spin the tubular members to make up the joint, then torque the pipe to its make-up torque; or, break-out the pipe, then spin out the tubular member to complete disengagement. These units are heavy weighing in excess of 5,000 kg, require drive tracks or rails and are expensive.

As previously noted, so far as known to applicant, none of the automatic tong devices permitted the coupling or decoupling of stabilizers and bits to or from the drill string. These actions have historically been accomplished by pulling the drill string out of the well bore and manually engaging the tubular joint to be operated with a set of tongs, which are manipulated onto the rig floor by rig personnel. Applicant has devised tools for both spinning the drill string while holding a lower portion to make-up the tool joint, which also tightens the joint to operating torque after makeup. See for example, U.S. Pat. No. 6,212,976; International Publication WO 99/10130, PCT application number PCT/US98/17868; and U.S. Pat. No. 5,351,767; all of which are hereby incorporated herein by reference in their entireties as if copied verbatim herein. The present invention permits the applicant's existing tools, which spins and/or torque the drill string, to be used to automatically add and remove either stabilizers and drill bits on the drill string. This operation may be accomplished quickly and easily without additional equipment being moved onto the overcrowded rig floor. The apparatus may be suspended by conventional support means that permit the ready movement of the device out of the way of other rig operations.

SUMMARY OF THE INVENTION

The present invention is a wrench apparatus having utility to make up and break out a connection between a drill bit or a stabilizer and the drill string. The apparatus comprises an upper assembly having a gripper which is capable of gripping the drill string and a lower assembly which is capable of gripping the drill bit or stabilizer and a torque applicator for turning the upper gripping means and the lower gripping means in selectively opposite directions.

In one aspect, the present invention provides a wrench for make up and break out of a connection between a drill bit or stabilizer having a non-circular cross section and a drill pipe joint disposed along an upright axis. The wrench has an upper assembly comprising a first pipe gripper operable along an angle transverse to the upright axis for holding the drill pipe joint against rotation about the upright axis with respect to the upper assembly. A lower assembly depends from the upper assembly and comprises a drill bit- or stabilizer-receiving member having a non-circular opening matching the cross section of the drill bit or stabilizer for securing the drill bit or stabilizer against rotation about the upright axis with respect to the lower assembly. The lower assembly is rotatably secured with respect to the upper assembly to allow rotation of the upper and lower assemblies with respect to each other about the upright axis. A torque applicator is secured to the upper and lower assemblies for rotating the upper and lower assemblies with respect to each other. A lateral gate opening can be formed in the upper assembly for receiving the drill pipe joint in the pipe gripper.

The wrench preferably also includes a spinner yieldably mounted on the upper assembly for rotating the drill pipe joint about the upright axis with respect to the lower assembly. Springs can be provided between the upper assembly and the spinner. The lower assembly can include a housing for a second pipe gripper operable along an angle transverse to the upright axis for holding a drill pipe joint against rotation about the upright axis with respect to the lower assembly, and a lateral gate opening formed in the housing for receiving a drill pipe joint in the second pipe gripper.

The pipe gripper is preferably a jaw assembly. The jaw assembly can include a housing, a seating jaw and an opposed locking jaw movable toward the seating jaw along an operating axis of the jaw assembly at a transverse angle to the upright axis for securing the drill pipe joint between the jaws.

The drill bit- or stabilizer-receiving member is preferably supported by torque stabilizers removably supported from the housing in torque transmitting relation thereto. The opening is preferably formed in a transverse plate securely attached to the torque stabilizers. The transverse plate preferably has left and right sections hingedly connected at one side of the opening and lockable at an opposite side of the opening. The drill bit- or stabilizer-receiving member can include a drill bit lock secured to the transverse plate and movable into and from locking relation with the drill bit or stabilizer.

The vertical support is preferably movable transversely with respect to the upright axis between a first position wherein the pipe gripper is aligned with a drill string of a drilling rig and a second position disposed away from the drill string.

In another aspect, the present invention provides a method for breaking out a connection between a drill bit or stabilizer and a drill pipe section having a complementary threaded coupling. The method includes the steps of:

(a) positioning the drill bit or stabilizer in the opening of the drill bit- or stabilizer-receiving member of the wrench described above to secure the drill bit or stabilizer against rotation with respect to the lower assembly;

(b) inserting the drill pipe section through the lateral gate and into alignment with the pipe gripper in the upper assembly;

(c) holding the drill pipe section in the pipe gripper against rotation with respect to the upper assembly;

(d) actuating the torque applicator to rotate the upper assembly with respect to the lower assembly and loosen the connection.

The method can also include the steps of releasing the pipe gripper and spinning the drill pipe, while continuing to secure the drill bit or stabilizer against rotation with respect to the lower assembly, to disconnect the drill pipe from the drill bit or stabilizer.

In a further aspect, the present invention provides a method for making up a connection between a drill bit or stabilizer and a drill pipe section having a complementary threaded coupling. The method includes the steps of:

(a) positioning the drill bit or stabilizer in the opening of the drill bit- or stabilizer-receiving member of the wrench described above to secure the drill bit or stabilizer against rotation with respect to the lower assembly;

(b) engaging a lower end of the drill pipe section in the drill bit or stabilizer and spinning the drill pipe with respect to the lower assembly to shoulder the connection between the drill pipe and the drill bit or stabilizer;

(c) engaging the pipe gripper in the upper assembly to hold the drill pipe section in the pipe gripper against rotation with respect to the upper assembly;

(d) actuating the torque applicator to rotate the lower assembly with respect to the upper assembly to tighten the connection.

Where the wrench includes the spinner yieldably mounted on the upper assembly thereof, the spinning step preferably includes operation of the spinner.

In yet another aspect, the present invention provides an apparatus for coupling and decoupling downhole tools from a drill string on the rig floor. The apparatus has a plate providing a hole in the center having a non-circular geometric profile suitable for engagement of an exterior surface of the downhole tool. One or more arms extend upwardly from the plate for attaching the plate in spaced, torque-transmitting relationship below a hydraulically actuated wrench. The apparatus can also include a power wrench having brackets on a lower end thereof for attachment to the at least one upwardly extending arms of the hinged lockable plates, whereby torque may be applied to the drill string while holding the downhole tool in a relatively fixed position. The plate is preferably made of a pair of hinged, lockable sections that have opposing mating surfaces that form the geometric profile.

DETAILED DESCRIPTION OF THE DRAWINGS

DESCRIPTION OF THE INVENTION

Figure 1:
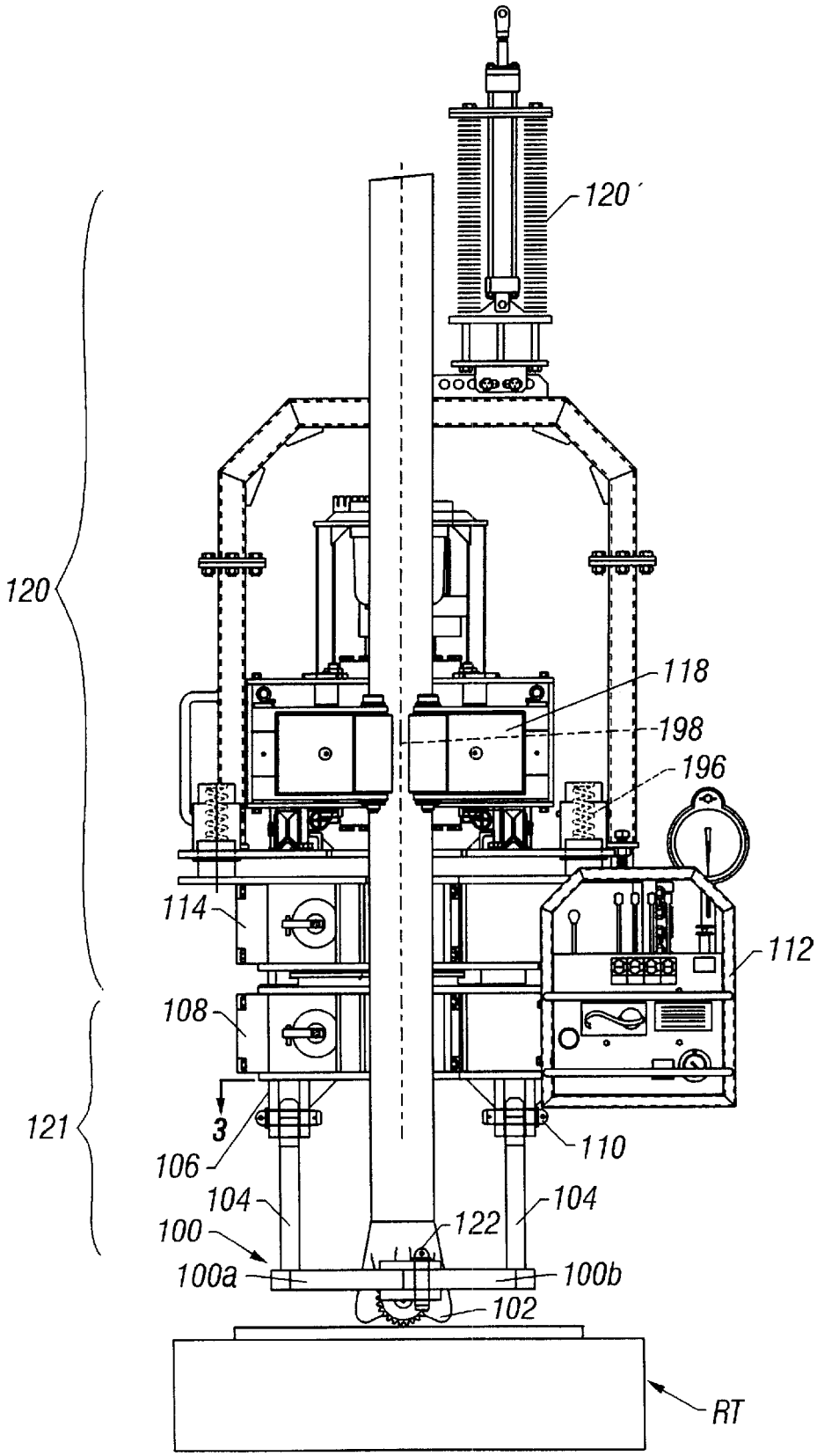
FIG. 1 is a front elevation of the spinner/power wrench apparatus engaging a drill pipe and drill bit.

With reference to the drawings wherein like reference numerals indicate like parts, one embodiment of the present invention involves a novel attachment of a bitbreaker to a wrench device that holds the bit or stabilizer in a locked position while the torque providing jaws of the wrench device either make up or break out the bit from the drill string. This is accomplished by attaching a hinged and lockable set of plates 100, shown generally in FIG. 1, around either the bit 102 or the stabilizer (shown more clearly in FIG. 9) to be connected or disconnected, while the elevators hold the bit 102 or stabilizer 102' adjacent the rig floor. For the purposes of illustration and clarity, reference is made hereinbelow to the bit 102, with the understanding that the invention is likewise applicable to stabilizers.

The hinged plates 100 are fitted to the profile of the bit 102, which is usually triangular in shape to accommodate tricone bit profiles and three bladed stabilizers. It should be recognized that the lockable, hinged plate may be made in a number of different geometric shapes to accommodate the geometry of other types of stabilizers and bits. If the bit 102 is circular in cross-section, or if otherwise desired, the bit 102 can be locked in place with a conventional bit lock (more clearly shown in FIGS. 9 and 10). The plates 100 are then locked into place over the tricone bit profile while it sits on the rotary table RT. The power wrench device is then lowered into place adjacent the plate 100, consisting of two cooperating segments 100*a* and 100*b* to permit the attachment of the torque transfer arms 104 of the device. The torque transfer arms 104 of the plate 100 are bolted to bracket 106 provided on the lower torque jaws 108 of the power wrench by pins 110. The operator then applies hydraulic pressure controlled by the panel 112 located on the device to apply either right-hand torque to makeup either the bit 102, or left-hand torque to disconnect the bit 102 from the drill string in a manner well known in the drilling industry.

The power wrench is composed of two pipe-gripping elements, which operate by gripping the tubular member with two sets of jaws 108, 114 along an angle transverse to the longitudinal axis of the pipe. Typically hydraulic elements urge the jaws 108, 114 into engagement with the pipe and the operator through the panel 112 may selectively control each. The upper assembly 120 is suspended adjacent the drill pipe by its hoisting harness 120' providing vertical support for the entire assembly. The upper assembly 120 is hingedly connected to the lower assembly 121 which supports the lower jaws 108 and the brackets 106 and plate 100. The operator will position the spinner assembly 118 by moving the drill pipe into the lateral opening 198 of the spinner assembly 118. Springs 196 permit longitudinal movement of the upper assembly as the pipe is connected or disconnected.

Figure 2:
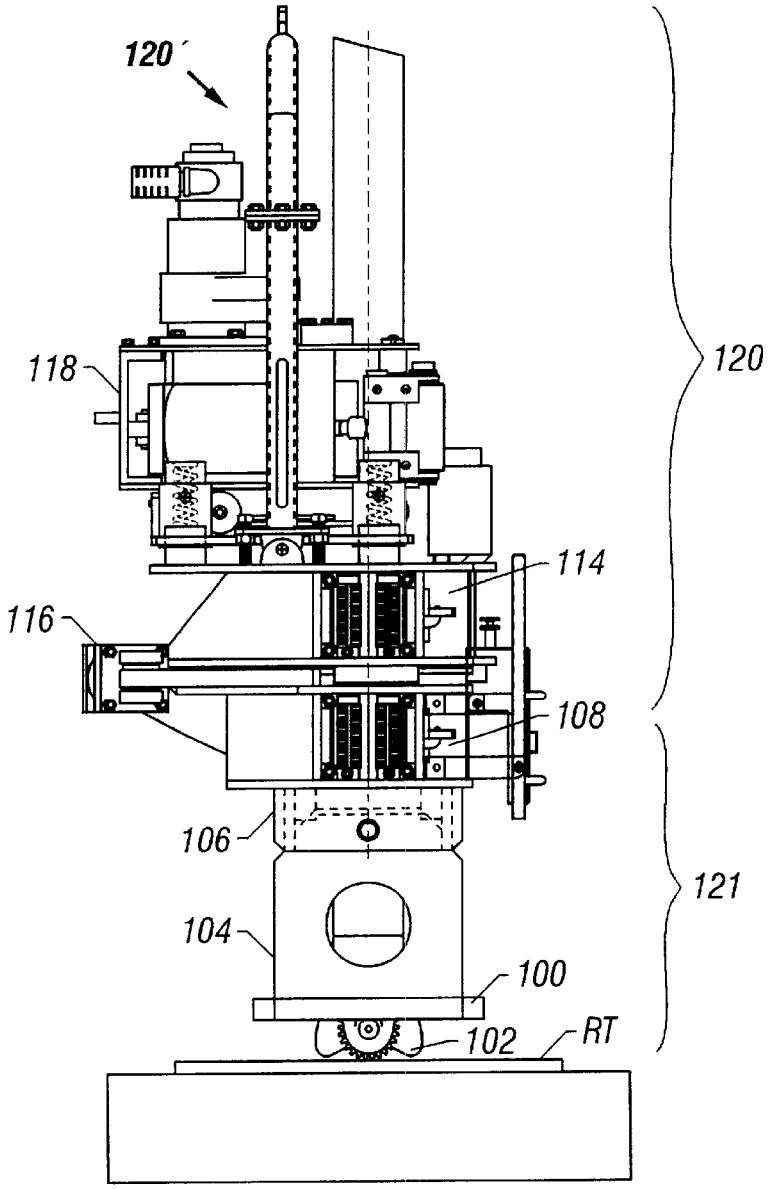
FIG. 2 is a side elevation of the spinner/power wrench apparatus engaging a drill pipe and drill bit.

The spinner assembly 118 is used to spin the drill pipe to be connected onto the drill bit or stabilizer in a manner well known to those in the pipe handling art. The torque to complete the connection is applied by engaging the upper torque assembly 114 to impart torque in the drill pipe/drill bit assembly. Regular joints of pipe are connected in the normal manner engaging the upper torque jaws 114 and the lower torque jaws 108 and moving them in the appropriate direction by engaging torque cylinder 116. The torque cylinder 116 best seen in FIG. 2 is then activated to apply a torquing force to the housings of the jaws 108, 114. In the present invention, the lower jaws 108 are not allowed to engage to grip the pipe so the torque is transmitted through the torque transfer arms 104 to the locked plate 100 to either torque the bit 102 to the operating torque or to disconnect or break the bit 102 from the tubular member.

To make up the bit 102 to the drill string, the bit 102 is locked into the plate 100, and the spinner 118 is activated to spin the drill pipe into engagement with the bit 102. Then the operator applies the appropriate torque to the bit 102 to make up the tool to its rated make up torque. Once torquing is completed, the hinged plates 100 may be unlocked from the bit 102, which is then lowered through the plates 100 and rotary table RT into the well bore.

To disconnect the bit or stabilizer, torque is applied by the torque cylinder 116 to break the connection and once the seal is broken upon breakout and the torque declines, the spinner mechanism 118 can be activated to complete the disconnection.

Figure 3:
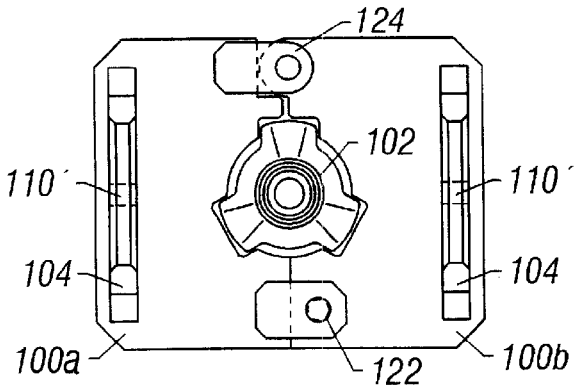
FIG. 3 is a top view of the bit breaker plate showing the location of the hinge and lock pin.
Figure 4:
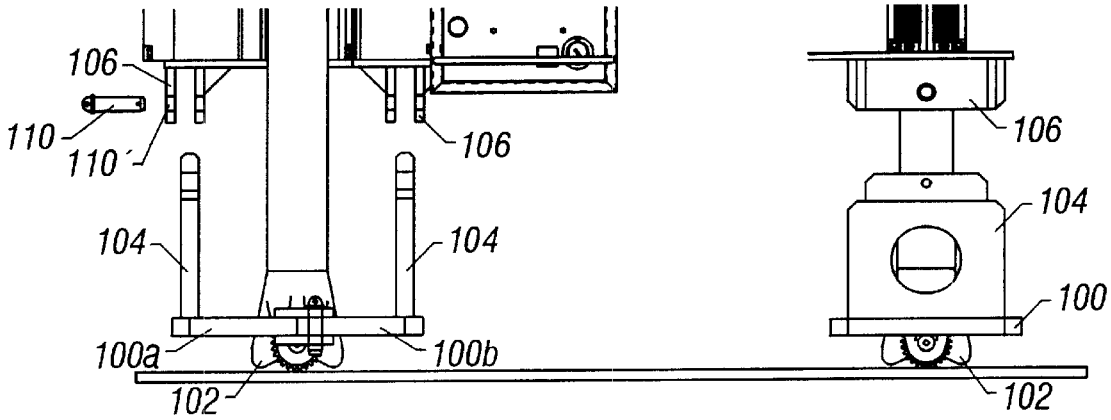
FIG. 4 is schematic representation (both front and side) of the bitbreaker after installation around the drill bit and before engagement with the power wrench apparatus.
Figure 5:
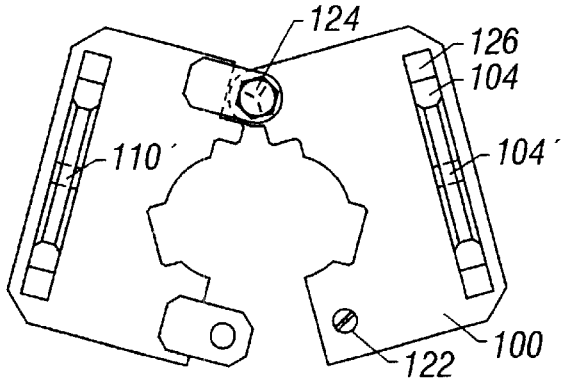
FIG. 5 is a top view of the hinged plate portion of the apparatus through the line 3 with the pin and hinge attached in its open position ready to be placed around the bit or stabilizer body to be connected.
Figure 6:
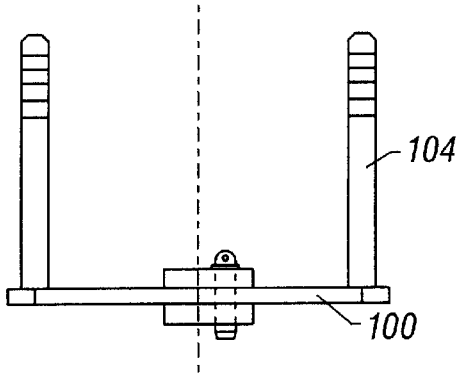
FIG. 6 is a frontal view of the hinged plate portion of the apparatus in the closed position with the pin inserted.
Figure 7:
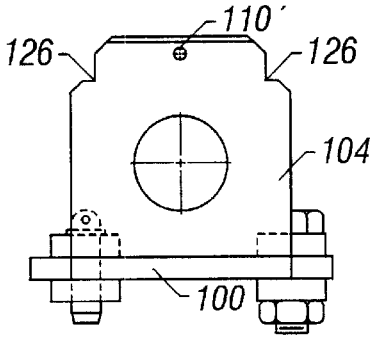
FIG. 7 is a side view of an embodiment of the hinged plate showing the relative placement of the attaching pinholes.

FIG. 1 shows a complete assembly of the power wrench and spinner assembly 118 in its hoisting harness 120' with the lockable, hinged plate 100 attached by the torque transfer arms 104 to the bottom by brackets 106 below the lower jaws 108. The bit 102 has been previously locked into place and the hinged plates 100 closed and bolted by attaching pins 110 in holes 110' in the assembly. FIG. 3 more clearly demonstrates the hinged lockable plate after engagement to the bit 102, but before lowering the power wrench, spinner assembly to be connected to the upper torque transfer arms 104 of the plates 100 by attaching pins 110 which are inserted and engaged in the holes 110'.

FIG. 2 shows a side view of the apparatus of FIG. 1 with the bit 102 engaged in the lockable plate 100. Disconnection of the bit 102 would be effected by engaging upper jaws 114 to move with left hand torque. Connection of the bit would be accomplished in a reverse manner. Sixty thousand foot-pounds of torque may be applied to make up a bit 102 to the drill string without damage to either the bit 102 or the drill string. Seventy thousand foot-pounds of torque may be applied to break apart the bit or stabilizer from the drill string without damage to either the bit 102 or the drill string.

To operate the device, the hinged plate 100 is locked around the bit 102, for example, by moving the two cooperating plates 100*a* and 100*b* around the bit 102 and locking them in place by inserting pin 122 in the hole 122' provided on each of the plates 100. The operator, standing at the console 112 would lower the drill string onto the drill bit 102 and engage the spinner 118 which would spin up the connection. Thereafter, the final operating torque would be applied by applying right hand torque by the upper jaws 114 to the drill string to tighten the bit 102 to the desired torque which is measured on the torque gauge on the operator's console 112 in a manner well known in the drilling industry.

FIG. 3 is a top view of the transverse hinged plates 100 used to couple and decouple the bit 102 from the drill string. As may be readily appreciated, the bottom plates 100 comprises two interconnected pieces 100*a* and 100*b* that are hinged by connector 124 and provide mateable surfaces providing a hole 122' therethrough for a locking pin 122. In operation, the hinged plate 100 is moved over the bit 102 by ordinary lifting means well known to this industry, such as by an air hoist, and set on the profile (which, in this embodiment, is generally triangular), and manually closed. Thereafter, locking pin 122 is inserted in the hole 122' provided. The upper assembly 120 is lowered over the torque transfer arms 104 to seat on shoulder 126 and the attaching pins 110 are inserted in the holes 110' provided in the bracket 106 provided on the lower surface of the lower torque applicator body 108. Torque is then applied selectively by manipulation of the upper jaws 114 to either couple or decouple the bit 102, which is locked in the hinged plate 100.

Figure 8:
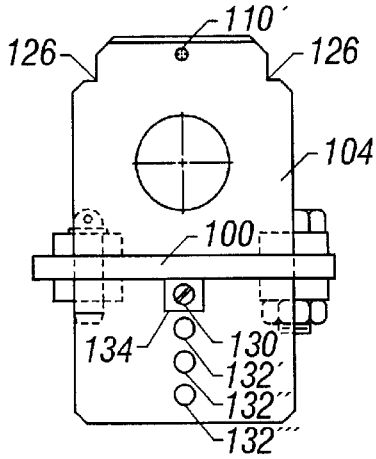
FIG. 8 is a side view of another embodiment of the hinged plate showing multiple attaching pinhole arrangements for accommodating longer bits or stabilizers in the tool.

As may be readily appreciated with reference to FIG. 8, differing lengths of tools or subs may be accommodated within the hinged plates 102 by placing attaching pins 130 through a lower or higher hole location 132 as desired. In this embodiment, the torque transfer arms 104 are elongated and pass through a slot formed in the plates 100 and adjacent a lug 134 attached to a lower side of the plates 100. If the desired coupling/decoupling desired related to an extended length stabilizer assembly, the longer stabilizer could be loaded in the hinged plate and the locking pin placed in a higher hole 132', intermediate hole 132' or lower hole 132''' as desired.

Figure 9:
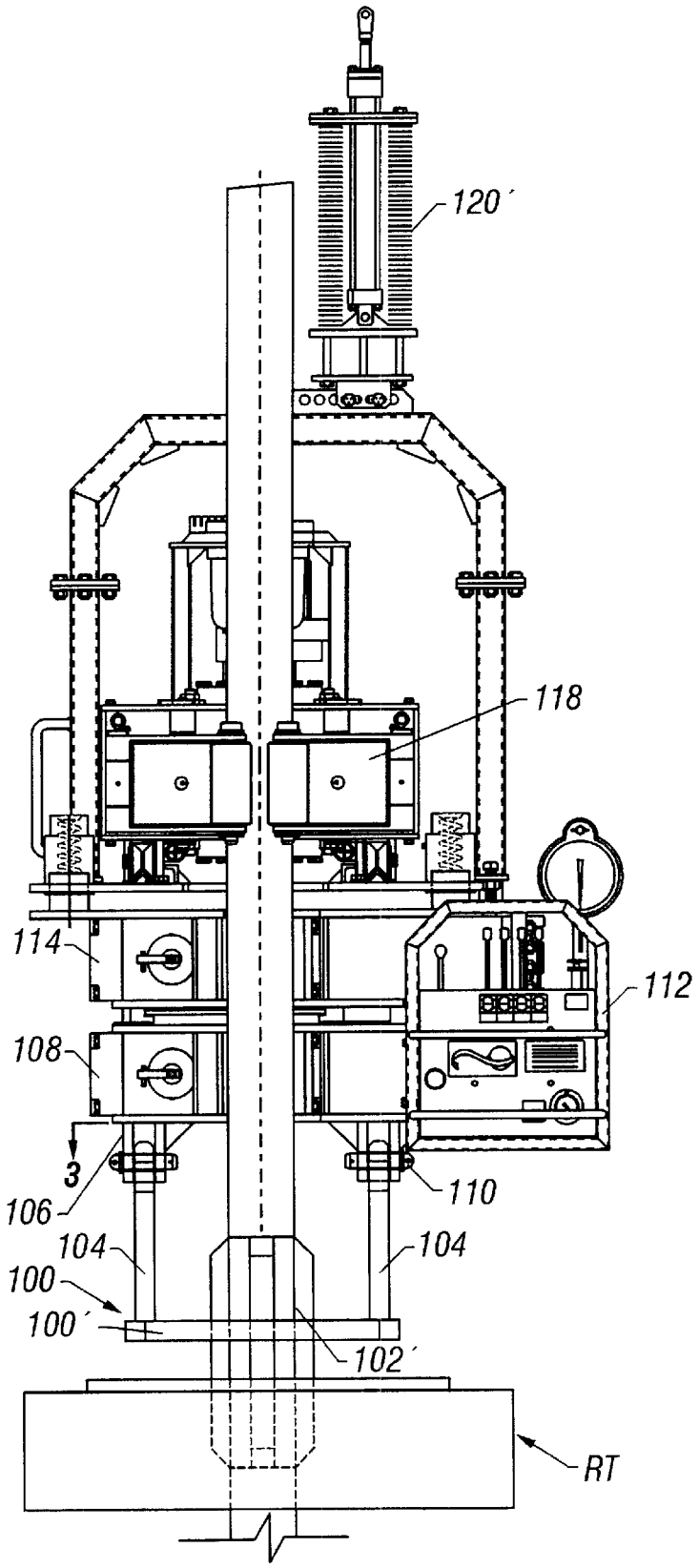
FIG. 9 is a front elevation of the spinner/power wrench engaging a stabilizer connected to a drill pipe.

FIG. 9 shows another embodiment of the apparatus of the present invention deployed with a bit lock BL plate that is removably seated in a recess in the bottom plate 100' in a manner well known in the oil and gas industry. Bottom plate 100' is a unitary member attached by torque transfer arms 104 in the same manner as described above, by attachment to the lower surface of the torque applicator body 108 by bracket 106. FIG. 9 also shows the use of the invention to connect and disconnect a drill pipe stabilizer 102' in a drill pipe.

Figure 10:
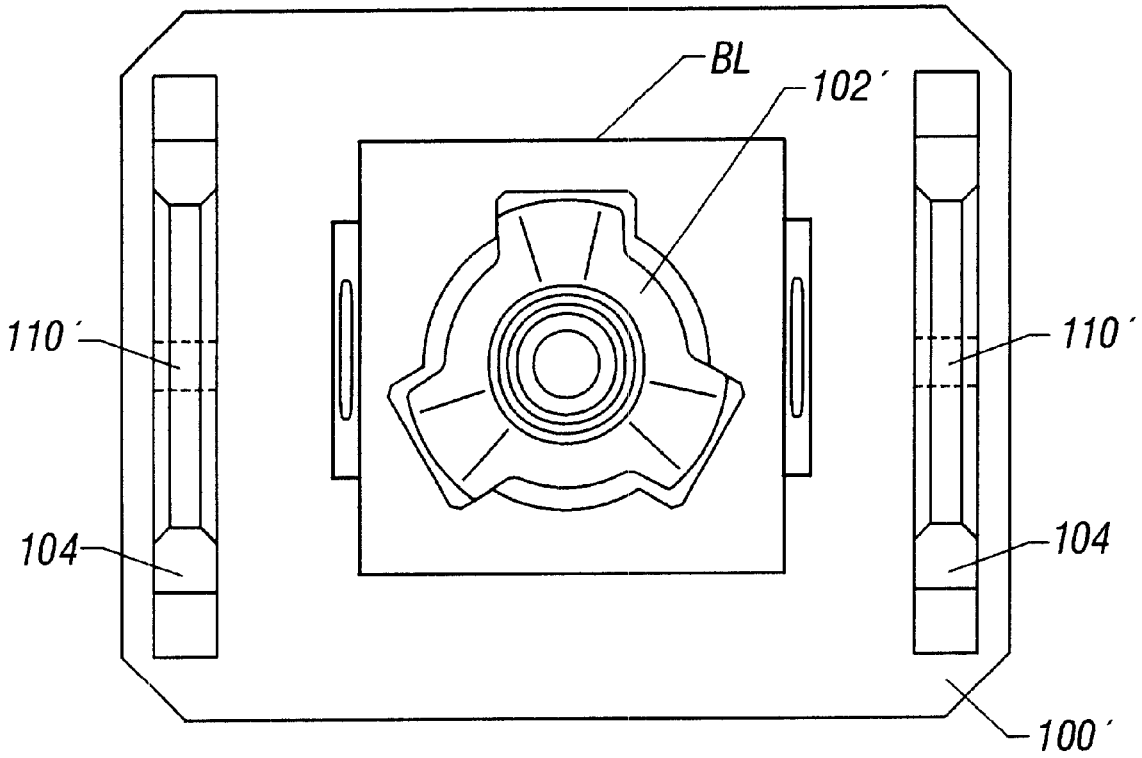
FIG. 10 is a top view of the FIG. 9 embodiment showing a removable bit breaker plate.

FIG. 10 is a top view of the lower plate of the alternative embodiment of the invention using a bit lock plate BL. The bit lock plate BL is inserted in a recess in the lower plate 100' and the drill pipe lowered or raised to engage the bit in the profile of the plate.

It may also be appreciated that the apparatus of the present invention may also be used with a power tong apparatus well known to those in the industry by attaching the hinged plates 100 or the fixed plate 100' with bit lock insert in the foregoing described manner to the lower torque-applying surface of the power tongs. It should also be further appreciated that the spinner/power tong apparatus is not needed to utilize the coupling/decoupling features of the present invention, which may be useful when used solely in conjunction with the power wrenches.

What is claimed is:

1. A wrench for make up and break out of a connection between a drill bit or stabilizer having a non-circular cross section and a drill pipe joint disposed along an upright axis, comprising:

an upper assembly comprising a pipe gripper operable along an angle transverse to the upright axis for holding the drill pipe joint against rotation about the upright axis with respect to the upper assembly;

a lower assembly depending from the upper assembly and comprising a drill bit or stabilizer receiving member having a non-circular opening matching the cross section of the drill bit or stabilizer for securing the drill bit or stabilizer against rotation about the upright axis with respect to the lower assembly, wherein the lower assembly is rotatably secured with respect to the upper assembly to allow rotation of the upper and lower assemblies with respect to each other about the upright axis;

a torque applicator secured to the upper and lower assemblies for rotating the upper and lower assemblies with respect to each other;

a lateral gate opening formed in the upper assembly for receiving the drill pipe joint in the pipe gripper.

2. The wrench of claim 1 further comprising a spinner yieldably mounted on the upper assembly for rotating the drill pipe joint about the upright axis with respect to the lower assembly.

3. The wrench of claim 1 wherein the lower assembly includes a housing for a second pipe gripper operable along an angle transverse to the upright axis for holding a drill pipe joint against rotation about the upright axis with respect to the lower assembly, and a lateral gate opening formed in the housing for receiving a drill pipe joint in the second pipe gripper.

4. The wrench of claim 1 wherein the pipe gripper comprises a jaw assembly.

5. The wrench of claim 4 wherein the jaw assembly comprises a housing, a seating jaw and an opposed locking jaw movable toward the seating jaw along an operating axis of the jaw assembly at a transverse angle to the upright axis for securing the drill pipe joint between the jaws.

6. The wrench of claim 3 wherein at least two torque transfer arms support the drill bit- or stabilizer-receiving member removably supported from the housing in torque transmitting relation thereto.

7. The wrench of claim 6 wherein the non-circular opening is formed in a transverse plate securely attached to the torque transfer arms.

8. The wrench of claim 7 wherein the transverse plate comprises left and right sections hingedly connected at one side of the opening and lockable at an opposite side of the opening.

9. The wrench of claim 8 wherein the drill bit- or stabilizer-receiving member includes a drill bit lock secured to the transverse plate and movable into and from locking relation with the drill bit or stabilizer.

10. The wrench of claim 2 comprising springs between the upper assembly and the spinner.

11. The wrench of claim 1 further comprising a hoisting harness for transversely moving the wrench with respect to the upright axis between a first position wherein the pipe gripper is aligned with a drill string of a drilling rig and a second position disposed away from the drill string.

12. A method for breaking out a connection between a drill bit or stabilizer and a drill pipe section having a joint with a complementary threaded coupling, comprising:

(a) providing a wrench comprising:

an upper assembly comprising a pipe gripper operable along an angle transverse to an upright axis for holding the drill pipe joint against rotation about the upright axis with respect to the upper assembly;

a lower assembly depending from the upper assembly and comprising a drill bit- or stabilizer-receiving member having a non-circular opening matching the cross section of the drill bit or stabilizer for securing the drill bit or stabilizer against rotation about the upright axis with respect to the lower assembly, wherein the lower assembly is rotatably secured with respect to the upper assembly to allow rotation of the upper and lower assemblies with respect to each other about the upright axis;

a torque applicator secured to the upper and lower assemblies for rotating the upper and lower assemblies with respect to each other;

a lateral gate opening formed in the upper assembly for receiving the drill pipe joint in the pipe gripper;

(b) positioning the drill bit or stabilizer in the opening of the drill bit- or stabilizer-receiving member of the wrench to secure the drill bit or stabilizer against rotation with respect to the lower assembly;

(c) inserting the drill pipe section through the lateral gate and into alignment with the pipe gripper in the upper assembly;

(d) holding the drill pipe section in the pipe gripper against rotation with respect to the upper assembly;

(e) actuating the torque applicator to rotate the upper assembly with respect to the lower assembly and loosen the connection.

13. The method of claim 12, further comprising releasing the pipe gripper and spinning the drill pipe, while continuing to secure the drill bit or stabilizer against rotation with respect to the lower assembly, to disconnect the drill pipe from the drill bit or stabilizer.

14. A method for making up a connection between a drill bit or stabilizer and a drill pipe section having a complementary threaded coupling, comprising:

(a) providing a wrench comprising:

an upper assembly comprising a pipe gripper operable along an angle transverse to an upright axis for holding the drill pipe joint against rotation about the upright axis with respect to the upper assembly;

a lower assembly depending from the upper assembly and comprising a drill bit- or stabilizer-receiving member having a non-circular opening matching the cross section of the drill bit or stabilizer for securing the drill bit or stabilizer against rotation about the upright axis with respect to the lower assembly, wherein the lower assembly is rotatably secured with respect to the upper assembly to allow rotation of the upper and lower assemblies with respect to each other about the upright axis;

a torque applicator secured to the upper and lower assemblies for rotating the upper and lower assemblies with respect to each other;

a lateral gate opening formed in the upper assembly for receiving the drill pipe joint in the pipe gripper;

(b) positioning the drill bit or stabilizer in the opening of the drill bit- or stabilizer-receiving member of the wrench to secure the drill bit or stabilizer against rotation with respect to the lower assembly;

(c) engaging a lower end of the drill pipe section in the drill bit or stabilizer and spinning the drill pipe with respect to the lower assembly to shoulder the connection between the drill pipe and the drill bit or stabilizer;

(d) engaging the pipe gripper in the upper assembly to hold the drill pipe section in the pipe gripper against rotation with respect to the upper assembly;

(e) actuating the torque applicator to rotate the lower assembly with respect to the upper assembly to tighten the connection.

15. The method of claim 14 wherein the wrench comprises a spinner yieldably mounted on the upper assembly thereof and said spinning comprises operation of the spinner.

16. A power wrench attachment for adapting the wrench for coupling and decoupling downhole tools from a drill string on a rig floor, wherein the wrench includes a pair of brackets on opposite sides of the wrench for connecting the attachment, comprising:

a plate providing a hole having a non-circular geometric profile suitable for engagement of an exterior surface of the downhole tool;

a pair of elongated arms extending upwardly from the plate on either side of the hole for attaching the plate to the wrench in spaced relationship therewith, and for transmitting torque from the wrench to the plate;

a transverse opening formed in each of the arms at an upper end thereof and spaced from the plate for releasable engagement with the brackets of the wrench.

17. A plate in combination with a power wrench for coupling and decoupling downhole tools from a drill string on the rig floor, comprising:

a plate providing a hole having a non-circular geometric profile suitable for engagement of an exterior surface of the downhole tool;

one or more arms extending upwardly from the plate and attached to brackets on a lower end of a power wrench for transmitting torque from the wrench to the plate whereby torque may be applied to the drill string while holding the downhole tool in a relatively fixed position.

18. The apparatus of claim 16 wherein the plate comprises a pair of hinged, lockable sections forming the geometric profile between opposing mating surfaces.

19. The power wrench attachment of claim 16 wherein the openings are cylindrical and further comprising a pair of pins each releasably received in a respective opening.

20. The power wrench attachment of claim 16 further comprising a bit lock releasably received in the hole.

* * * * *